United States Patent [19]

Saito et al.

[11] Patent Number: 4,819,781

[45] Date of Patent: Apr. 11, 1989

[54] PASSENGER CONVEYOR WITH UNITARY BALUSTRADE PANEL SUPPORT MEMBERS

[75] Inventors: Chuichi Saito; Masamitsu Hanano, both of Katsuta, Japan

[73] Assignees: Hitachi, Ltd., Tokyo; Hitachi Elevator Engineering Co., Ltd., Ibaraki, both of Japan

[21] Appl. No.: 41,229

[22] Filed: Apr. 22, 1987

[30] Foreign Application Priority Data

Apr. 22, 1986 [JP] Japan ..... 61-91248

[51] Int. Cl.[4] ..... B66B 23/22; B66B 23/24

[52] U.S. Cl. ..... 198/335

[58] Field of Search ..... 198/335, 337; 52/184, 52/397, 403

[56] References Cited

U.S. PATENT DOCUMENTS

| | | | |
|---|---|---|---|
| 3,321,059 | 5/1967 | Kroepel . | |
| 3,926,296 | 12/1975 | Woodling et al. | 198/335 X |
| 3,989,133 | 11/1976 | Courson et al. . | |
| 3,991,877 | 11/1976 | Kraft et al. | 198/335 |
| 4,627,527 | 12/1986 | Saito | 198/335 |
| 4,646,907 | 3/1987 | Streibig et al. | 198/335 |
| 4,690,264 | 9/1987 | Adrian et al. | 198/335 |

FOREIGN PATENT DOCUMENTS

| | | | |
|---|---|---|---|
| 1512084 | 2/1968 | France | 198/335 |
| 53-13786 | 2/1978 | Japan | 198/335 |
| 58-114281 | 8/1983 | Japan . | |

*Primary Examiner*—Robert J. Spar
*Assistant Examiner*—Cheryl L. Gastineau
*Attorney, Agent, or Firm*—Antonelli, Terry & Wands

[57] ABSTRACT

A passenger conveyor has a pair of balustrades on opposite sides of a plurality of steps connected together to circulate endlessly. Each of the balustrades comprises a structural support member mounted on a main body frame in spaced relation in the length direction of the main body frame. The structural support members each are made of a casing of one piece and have a U-shaped support portion supporting a lower end portion of the balustrade, a mounting flange portion projecting horizontally from one side of the U-shaped support portion, being mounted by the main body frame and mounting thereon an outer deck cover, a mounting projection horizontally projecting from the opposite side of the U-shaped support portion and mounting thereon an inner deck cover and skirt guard, and a pair of downward projections which serve to reinforce the U-shaped support portion as well as connection of a handrail guide for holding a handrail.

8 Claims, 3 Drawing Sheets

PASSENGER CONVEYOR WITH UNITARY BALUSTRADE PANEL SUPPORT MEMBERS

BACKGROUND OF THE INVENTION

This invention relates to a passenger conveyor such as an escalator, an electric moving sidewalk, and so on, and, more particularly, to a balustrade supporting structure of a passenger conveyor.

Passenger conveyors such as escalators and moving sidewalks should satisfy the requirements such as lightness in weight and high efficiency of assembling in addition to their fundamental requirements such as transportation function, design and safety.

Light weight and high efficiency of the assembly of the passenger conveyor are preferable in that the strength burden on a building where the passenger conveyors are disposed can be reduced and in that obstacles which may be caused in a process of building the building can be reduced.

A conventional passenger conveyor, generally, comprises a plurality of steps and a pair of moving handrails which circulate endlessly between one of landing area and another, and a pair of upstanding balustrades disposed at opposite sides of the steps for guiding the moving handrails. The balustrades each include balustrade panels, inner and outer deck covers disposed at lower portions of the balustrade panels, skirt guards, and so on, and constitute a design portion of the passenger conveyor as a whole.

The balustrade panels, the inner and outer deck covers, and the skirt guards, etc. are supported by a main body frame which is mounted on the floors of a building and supports the whole of the passenger conveyor, using a lot of structural members. An example of this construction is disclosed in Japanese Utility Model Laid-Open No. 114,281/1983, wherein a structural support member is secured to the main body frame to support the lower end portion of the balustrade panel in cooperation with a pressing plate and fastening bolts. The inner deck cover and skirt guard are mounted to the main body frame by other structural members. In this Laid-Open, although there is not shown a handrail guide frame disposed below the balustrade panel and to be secured to the main body frame, the handrail guide frame must be mounted to the main body frame by still another structural member because the structural support member supporting the balustrade panel is not illustrated so as to support the handrail guide frame.

In this construction, the structural support member supporting the balustrade panel is elongated in the direction of its length, and a lot of support members are used, so that the weight thereof is considerable. Use of a lot of structural support members prevents the assembly of the balustrade from raising assembly efficiency.

U.S. Pat. No. 3,989,133 also discloses a balustrade lower side portion, wherein elongated channel supports are used to receive and support the lower ends of balustrade panels. The channel supports are secured to the main body frame or truss by a plurality of clamp assemblies which are fastened to the main body frame in spaced relation. The clamp assembly bends the support channel to clamp the balustrade panels. The channel support is used in cooperation with a structural member with a similar groove receiving the balustrade panel. The channel support and the structural member are arranged end to end and joined by a splice member, using bolts. Since the splice member is insufficient by itself to provide the necessary support and lateral stability, the splice member is clamped by a newel clamp to provide necessary support. The newel clamp is constructed by various structural members.

As mentioned above, the balustrade lower portion structure disclosed in the U.S. Pat. No. 3,989,133 is provided with the elongated support channel and the various structural members for securing the balustrade panel to the main body frame. Therefore, it seems that the structure is sufficiently heavy and it takes sufficient time to assemble the structure.

Another example of the balustrade support structure is disclosed in U.S. Pat. No. 3,321,059. In this structure, a structural member, fastened to a supporting truss as a main body frame, is used for supporting a balustrade panel. The structural member has a vertical flange portion. Another structural member supports an elongated bar disposed around the bottom of the vertical flange portion along a running direction of steps. An upstanding bracket having a stud welded thereto is disposed so as to oppose the vertical flange portion of the structural member, thereby to provide a space for the balustrade panel lower portion. The balustrade panel is disposed on the elongated bar in the space and clamped by pressing the balustrade panel on the vertical flange portion of the structural member by screw bolts passing through the bracket and the elongated bar and screwed in the vertical flange portion, using an elongated strap. The structure disclosed in this U.S. patent also employs elongated members and various members for mounting the balustrade panel on the main body frame.

SUMMARY OF THE INVENTION

An object of the present invention is to provide a passenger conveyor which has a balustrade panel lower support construction which is simplified and lightened and which has an increased assembly precision.

Another object of the present invention is to provide the a passenger conveyor which is lightened in weight, reduces weight burden of the portion of a building on which the passenger conveyor is installed, and enables a rapid assembling of a balustrade panel lower support construction.

Briefly stated, a passenger conveyor according to the present invention is characterized in that a balustrade panel, and inner and outer deck covers are supported by structural support members each of which is short in length and of a unitary structural member of a casting. The structural support members are disposed in spaced relation in a length direction of the main body frame and have a U-shaped support portion for receiving therein and supporting the lower portion of the balustrade panel, a mounting flange portion, projecting from one side of the U-shaped support portion, mounted on a main body frame and securing thereon the outer deck cover, and a mounting projection, projecting from the other side of the U-shaped support portion and mounting thereon the inner deck cover.

The structural supports member support all the constituent components at the lower side portion of the balustrade. Therefore, various support members used in the conventional apparatus can be integrated into one unitary member, so that lightening the weight and improvement on assembly accuracy, etc. can be accomplished.

According to an aspect of the invention, the structural support member is further provided with a pair of downward projections projecting from the downward side of the U-shaped support portion and serving to reinforce the U-shaped support portion as well as connection of a handrail guide.

DETAILED DESCRIPTION OF THE INVENTION

Figure 1:
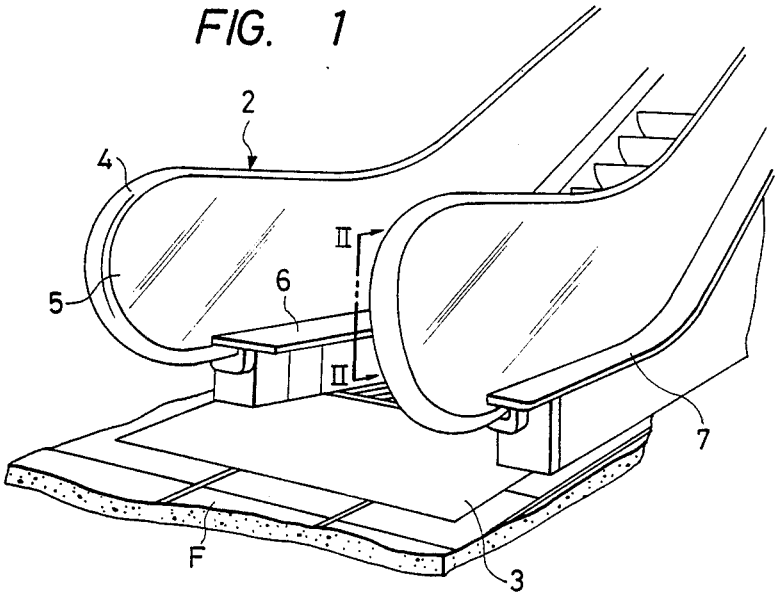
FIG. 1 is a perspective view of a part of a passenger conveyor.

Referring to FIG. 1, a passenger conveyor is illustrated. The passenger conveyor comprises a plurality of steps 1 connected together and extending from a landing area 3 to another area (not shown) to circulate therebetween. A pair of balustrades 2 are disposed on opposite sides of the steps 1 to form side walls which are supported by a main body frame mounted on a floor (F) or floors. The balustrades 2 each have a balustrade panel 5 of material such as transparent glass, a moving handrail 4 supported by the balustrade panel 5, inner and outer deck covers 6, 7 and a skirt guard. The balustrades 2 each are supported by the main body frame as shown in FIG. 2.

Figure 2:
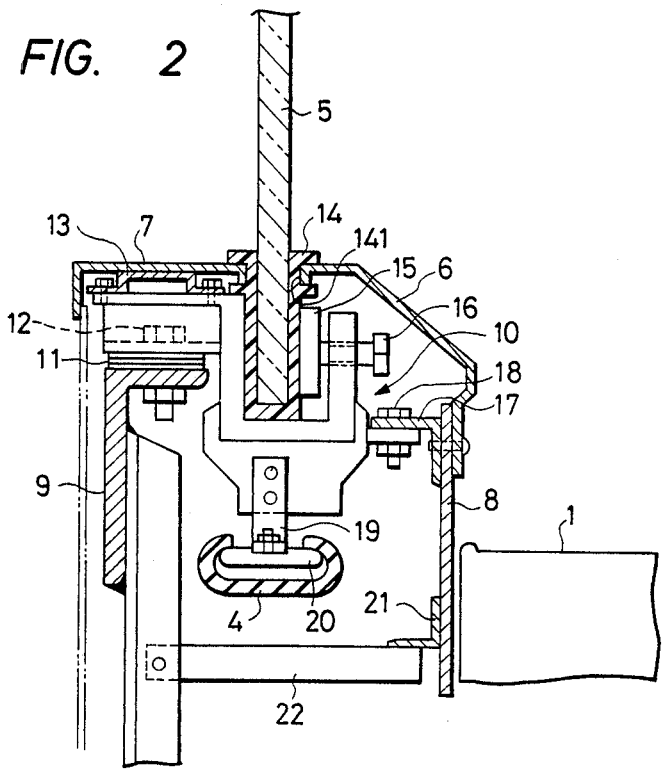
FIG. 2 is a sectional view of a balustrade according to an embodiment of the present invention, taken along a line 2–2 of FIG. 1.

In FIG. 2, the main body frame 9 is of a truss and has an upper chord member and struts. The balustrade 2 is supported by the main body frame 9 through a structural support member 10. The support member 10 is secured to the upper chord member of the main body frame 9 by bolts 12 through metal sheets 11 for adjusting the height of the structural support member 10, and has a plurality of mounting portions, that is, they are for the outer deck cover 7, the balustrade panel 5, the inner deck cover 6, the skirt guard 8, and the handrail 4.

Figure 3:
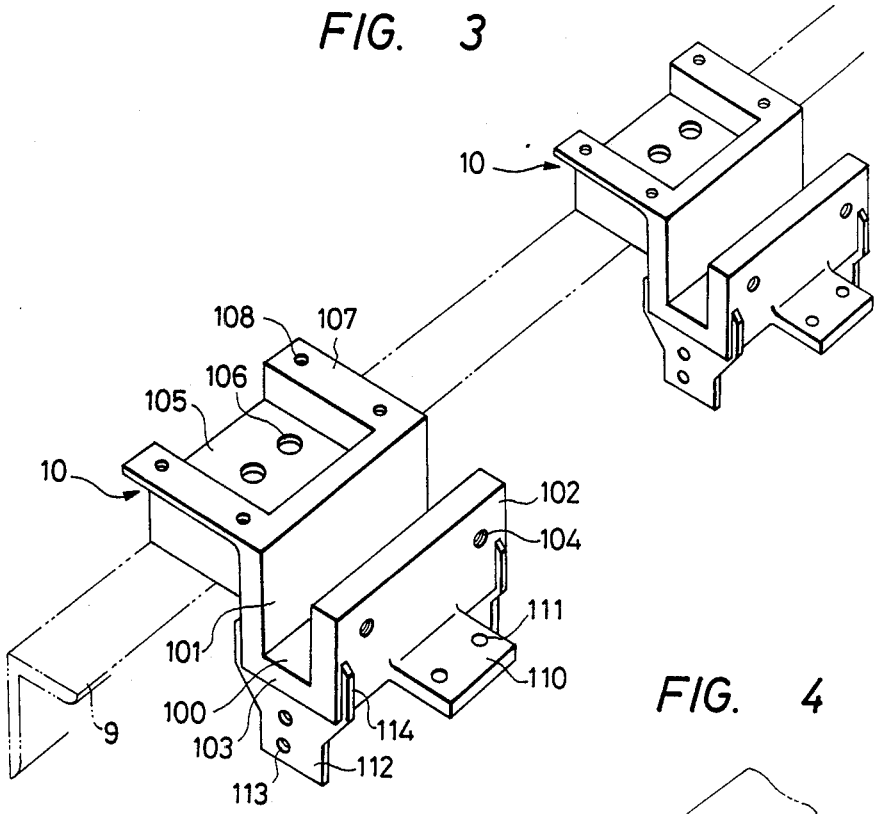
FIG. 3 is a perspective view of supports employed in the passenger conveyor.

The construction of the structural support member 10 is best shown in FIG. 3. In FIG. 3, the support member 10 is a casting and of one piece made of cast steel. The support member 10 comprises a U-shaped support portion 100 formed by a base portion 103, first and second side portions 101, 102 upstanding from the base portion thereby forming a U-shaped groove having a pair of side wall portions, and extending in the length direction of the main body frame 9.

The first side portion 101 has a mounting flange portion 105 projecting substantially horizontally therefrom. The mounting flange portion comprises a base 106 with holes and a pair of flat portions 107 upstanding from ends of the base 106. The flat portions 107 having threaded holes 108.

The second side portion 102 has threaded holes 104 at relatively upper portions thereof and a mounting projection 110 projecting substantially horizontally. The mounting projection 110 is disposed to align with the base portion 103 and has holes 111.

On the downward side of the base portion 103 of the U-shaped support portion 100, a pair of downward projections 112 with holes 113 are integrally provided so as to project downward. The downward projections 112 each are of plate like shape, the surface of which is on a plane substantially perpendicular to the length direction of the main body frame 9 so that they serve to reinforce the U-shaped support member 100. The U-shaped support member 100 is provided with ribs 114 extending from parts of the downward projections 112.

Referring back to FIG. 2, the structural support member 10 is secured by bolts 12 to the upper chord member of the main body frame 9 so as to project from one side thereof like a cantilever. The mounting flange portion 105 is formed with a recess defined by the base 106 and the pair of upstanding flat portions 107. The bolts 12 are submerged in the recess so that the heads of the bolts are kept below the flat portions 107. The structural support member 10 is adjusted so that the groove of the U-shaped portion 100 strictly aligns with the length direction of the main body frame and strictly upstands. The balustrade panel as made of transparent glass is about 2 m in length, for example. Such balustrade panel is supported at two positions, that is, by two support members 10 in a spaced relation as shown in FIG. 3.

The length of the structural support member 10 is 8% to 15% of the length of the balustrade panel 5, so that the support member 10 is lightened in weight, the above-mentioned adjustment is done easily and the assembling precision can be improved.

The balustrade panel 5 is covered by a packing 14 made of plastic around the lower portion. The plastic packing 14 is provided with flanges thereby to form a pair of grooves 141 for receiving the ends of the inner and outer deck covers 6, 7. The balustrade panel 5, the lower end portion of which is covered by the packing 14, is inserted into the U-shaped portion 100, and then a metal plate 15 is inserted to sandwich the lower portion of the balustrade panel 5 between the first side portion 101 and the metal plate 15. The metal plate 15 is pressed on the panel 5 by bolts screwed in the threaded holes of the second side portion 101, so that the panel 5 is clamped by the force generated between the metal plate 15 and the second side portion 102 and between the first and second side portions 101 and 102. The downward projections serve to effectively prevent the U-shaped support portion 100 from being deformed by the clamping force, so that the support member 100 can be reduced in its scale, which results in reduction in its weight.

The mounting projection 110 is fixed to a bar 17 by bolts 18. The bar extends in the length direction of the main body frame 9. The bar 17 is used in common with a lot of the support members 10. Even if a very large force is imparted to one of the structural support members 10 by the balustrade panel, the force is shared with the others through the bar, so that the balustrade is stable. The skirt guard 8 and the inner deck cover 6 are fixed to the bar 17 by screw means. The lower portion of the skirt guard 8 is secured to the main body frame 9, using a members 21 and 22.

The moving handrail 4 is supported by the downward projection 112. The projection 112 has a bracket 19 secured thereto by bolts. The bracket 19 holds the handrail guide 20 through connection by bolts.

The outer deck cover 7 is disposed on a bracket 13 fixed to the flat portions 107 of the mounting flange portion 105.

According to the embodiment described above, a large number of constituent components that have otherwise been disposed at the lower side portion of the balustrade in the conventional structure can all be integrated into the support member 10. Consequently, the weight and the number of components of an escalator or the like can be can be drastically improved in comparison with the conventional structures consisting of a large number of components. Less time is spent assembling the balustrade.

Figure 4:
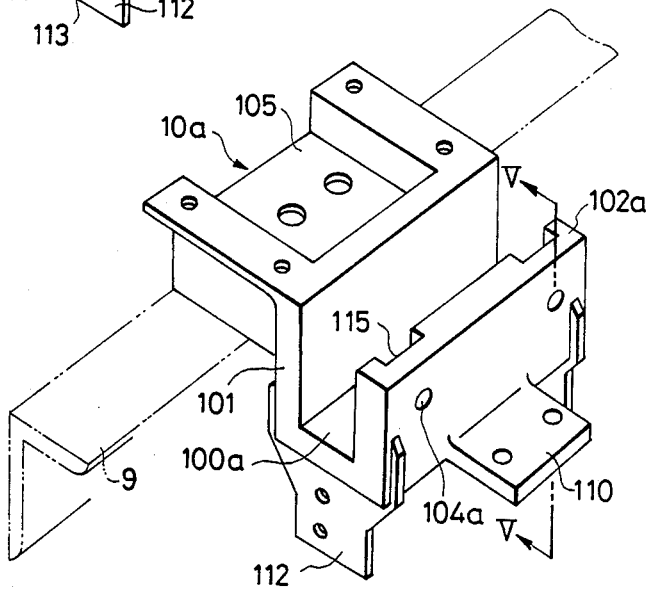
FIG. 4 is a perspective view of a support according to another embodiment of a balustrade.
Figure 5:
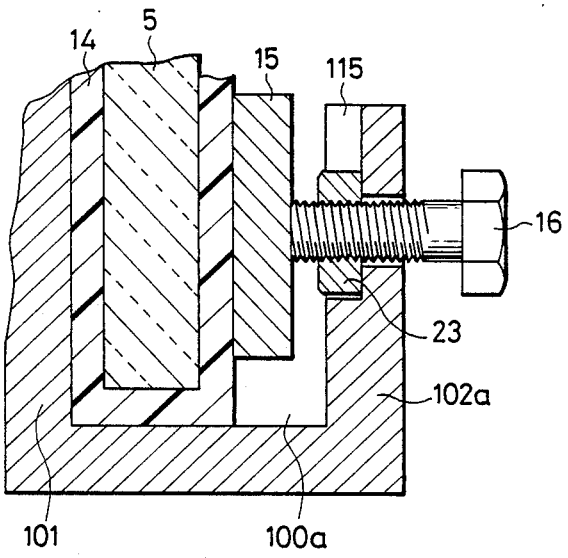
FIG. 5 is a sectional view of a part of the balustrade taken along a line 5–5 of FIG. 4.

Another embodiment is described referring to FIGS. 4 and 5.

This embodiment differs from the previous embodiment only in that a structural support member 10a has a pair of grooves 115 for receiving nuts 23 and through holes 104*a*, and the balustrade panel 5 is fastened by the metal plate 15 and the bolts 16 which pass through the through hole 104*a* and screwed into the nuts 23. Namely, the structural support member 10*a* comprises a mounting flange portion 105 mounted on the main body frame 9, a U-shaped support portion 100*a* having first and second side portions 101, 102*a* for supporting the balustrade panel 5, a mounting projection 110 for mounting thereon the inner deck cover 6, and a pair of downward projections 112 for mounting the handrail guide 20. This structural support member 10*a* supports the various parts of the balustrade as mentioned above.

In this embodiment, threaded holes such as holes 104 for relatively large scale bolts 16 are unnecessary, and the nuts 23 and through holes are used therefor. Therefore, the production of the support member 10*a* is easier than the support member 10.

We claim:

1. A passenger conveyor comprising a main body frame extending from one of two landing areas to the other, a plurality of steps connected together and mounted on said frame to circulate endlessly, a pair of moving handrails driven in synchronism with said steps and in the same direction as said steps, a pair of balustrades supported by said main body frame, disposed on opposite sides of said steps to form side walls and supporting said moving handrails, each of said balustrades including an upstanding balustrade panel, an inner deck cover, an outer deck cover and a skirt guard, characterized by comprising a plurality of structural support members mounted on said main body frame in spaced relation in the length direction of said main body frame, each of said structural support members made of one piece and having a U-shaped support portion extending in the length direction of said main body frame and providing opposite two, first and second, upstanding wall portions between which a lower portion of said balustrade panel is inserted, a mounting flange portion formed on one side of said U-shaped support portion and having an upper mounting portion on an upper side thereof for mounting thereon said outer deck cover, and a lower mounting portion on a lower side thereof for securing said structural support member to said body frame by screw means extending between said lower mounting portion and said main body frame, and a mounting projection formed on the other side of said U-shaped support portion, a bar elongated in the length direction of said main body frame and mounted on said mounting projection, said bar being common to said plurality of structural support members and secured thereto, said inner deck cover being mounted on said mounting projection through said bar, fastening means for pressing one side of said lower portion of said balustrade panel on said first upstanding wall portion of said U-shaped support portion by clamping force produced between said second upstanding wall portion and the other side of said lower portion of said balustrade panel opposing said second upstanding wall portion, and wherein said structural support member has at least one downwardly projecting projection extending from a lower side of said U-shaped support portion and a handrail guide mounted on said downwardly projecting projection for supporting a moving handrail.

2. The passenger conveyor according to claim 1, wherein said fastening means includes a plate provided to sandwich said lower portion of said balustrade panel in cooperation with said first upstanding wall portion of said U-shaped support portion and bolts engaged with said second upstanding wall portion of said U-shaped support portion to press said plate through a driving operation of said bolts, so that said clamping force is generated.

3. The passenger conveyor according to claim 2, wherein said structural support is provided with two downwardly projecting projections in spaced relation in the length direction of said main body frame, each of said two downwardly projecting projections being of plate-like shape, the surface of which is on a plane substantially perpendicular to the length direction of said main body frame, whereby said downwardly projecting projections reinforce said U-shaped support portions.

4. A passenger conveyor comprising a main body frame extending in its length direction, a plurality of steps connected together and mounted on said frame to circulate endlessly, a pair of moving handrails driven in synchronism with said steps and in the same direction as said steps, a pair of balustrades supported by said main body frame, disposed on opposite sides of said steps to form side walls and supporting said moving handrails, each of said balustrades including an upstanding balustrade panel, an inner deck cover, and outer deck cover and a skirt guard, characterized by comprising a plurality of structural support members mounted on said main body frame in spaced relation in the length direction of said main body frame, each of said structural support members made of one piece of a casting and having a U-shaped support portion, defining a groove for receiving therein a lower end portion of said upstanding balustrade panel and supporting said balustrade panel, said U-shaped support portion including a base portion, first and second side portions upstanding from opposite ends of said base portion, respectively, thereby providing said groove extending in the length direction of said main body frame, a mounting flange portion integrally formed on said first side portion of said U-shaped support portion so as to extend therefrom in a substantially perpendicular direction to said first side portion, and secured to said main body frame, said mounting flange portion having a pair of upper flat support portions for mounting thereon said outer deck cover, a mounting projection projecting from said second side portion of said U-shaped support portion in a substantially perpendicular direction to said second side portion and mounting thereon said inner deck cover, and at least one downward projection projecting downwards from the downward side of said base portion of said U-shaped support portion and mounting thereon a handrail guide for guiding said moving handrail, said downward projection being of a plate-like shape which is on a plane substantially perpendicular to the length direction of said main body frame thereby providing reinforcement of said U-shaped support portion; a plate disposed in said U-shaped support portion so as to sandwich said lower portion of said balustrade panel in cooperation with said first side portion of said U-shaped support portion; and bolts each engaged with said plate and said second side portion of said U-shaped support portion to produce clamping force therebetween whereby said lower portion of said balustrade panel is pressed on said first side portion of said U-shaped support portion by said plate.

5. The passenger conveyor according to claim 4, wherein a packing covering said lower portion of said balustrade panel is included, said lower portion of said balustrade panel being pressed on said first side portion by said plate through said packing, and said packing having a pair of grooves for fitting therein ends of said inner and outer deck covers.

6. The passenger conveyor according to claim 4, wherein said inner deck cover and said skirt guard are fixed to a bar and said mounting projection of each of said structural support members is connected to said bar.

7. The passenger conveyor according to claim 4, wherein in addition to said downward projection, another downward projection is provided on said downward side of said base portion of said U-shaped support portion to form a pair, said pair of downward projections being provided at end portions of said U-shaped support portion in the length direction of said main body frame, parts of said downward projections extending to said first and second side portions of said U-shaped support portions so that said U-shaped support portion is reinforced.

8. The passenger conveyor according to claim 4, wherein said second side portions of said U-shaped support portion is formed with recesses for receiving nuts, said bolts are screwed in said nuts received in said recesses thereby pressing said plate so as to press said lower portion of said balustrade panel on said first side portions of said U-shaped support portion.

* * * * *